United States Patent [19]

Merzhanov et al.

[11] 4,431,448

[45] Feb. 14, 1984

[54] TUNGSTEN-FREE HARD ALLOY AND PROCESS FOR PRODUCING SAME

[76] Inventors: Alexandr G. Merzhanov; Inna P. Borovinskaya, both of Chernogolovka, ulitsa 3-ia, 3, kv. 2; Lidia V. Kustova, Chernogolovka, ulitsa 1-ya, 23, kv. 35, all of, Moskovskaya oblast, Noginsky raion; Fedor I. Dubovitsky, Vorobievskoe shosse, 2 "B", kv. 12, Moscow, all of U.S.S.R.

[21] Appl. No.: 314,074

[22] PCT Filed: Jul. 31, 1980

[86] PCT No.: PCT/SU80/00133

§ 371 Date: Oct. 9, 1981

§ 102(e) Date: Oct. 9, 1981

[87] PCT Pub. No.: WO81/02431

PCT Pub. Date: Sep. 3, 1981

[30] Foreign Application Priority Data

Feb. 20, 1980 [SU] U.S.S.R. ..... 2880101

[51] Int. Cl.[3] ..... B22F 3/16; C22F 29/00

[52] U.S. Cl. ..... 75/238; 75/236; 419/12; 419/17; 419/45

[58] Field of Search ..... 75/202, 244, 247, 238, 75/203, 204, 236; 501/98; 407/119; 419/12, 17, 419/45

[56] References Cited

U.S. PATENT DOCUMENTS

| | | | |
|---|---|---|---|
| 2,084,349 | 6/1937 | Laise | 75/202 |
| 3,143,413 | 8/1964 | Krapf | 75/202 |
| 3,158,469 | 11/1964 | Kosco | 75/247 |
| 3,256,072 | 6/1966 | Bull | 75/238 |
| 3,301,673 | 1/1967 | Bridwell | 75/204 |
| 3,313,605 | 4/1967 | Gill | 75/238 |
| 3,551,991 | 1/1971 | Reich | 75/204 |
| 3,726,643 | 4/1973 | Merzhanov | 423/409 |
| 3,954,419 | 5/1976 | Kaufman | 75/202 |
| 4,067,743 | 1/1978 | Arabei | 75/247 |

FOREIGN PATENT DOCUMENTS

| | | | |
|---|---|---|---|
| 736428 | 6/1966 | Canada | 75/238 |
| 54-4004209 | 1/1979 | Japan | 75/238 |
| 866119 | 4/1961 | United Kingdom | 75/238 |

*Primary Examiner*—L. Dewayne Rutledge
*Assistant Examiner*—J. J. Zimmerman
*Attorney, Agent, or Firm*—McAulay, Fields, Fisher, Goldstein & Nissen

[57] ABSTRACT

A tungsten-free hard alloy consists of titanium diboride, titanium carbide and a binder. As the binder the tungsten-free hard alloy contains at least one of metals of subgroup IB of the periodic system inactive relative to boron or an alloy based on one of such metals. The components of the tungsten-free hard alloy are present in the following proportions, percent by mass:

titanium diboride—40 to 60
binder—3 to 30
titanium carbide—the balance.

The tungsten-free hard alloy of the above-specified composition has a porosity of below 1%.

A process for producing a tungsten-free hard alloy comprises preparation of the starting charge by intermixing powders of titanium, boron and carbon, compression of the charge local ignition thereof to initiate the exothermal reaction of titanium with boron and carbon which further proceeds spontaneously under burning conditions being propagated through the charge at the account of the heat transfer from a heated layer of the charge to a cold one. At the stage of the charge preparation, into its composition there is added a powder of at least one of metals of subgroup IB of the periodic system inactive to boron or a powder of an alloy based on one of such metals, or added are powders of metals forming this alloy under the conditions of the above-mentioned exothermal reaction. On completion of the exothermal reaction the resulting solid-liquid reaction mass is compressed to obtain porosity of below 1%.

18 Claims, No Drawings

TUNGSTEN-FREE HARD ALLOY AND PROCESS FOR PRODUCING SAME

FIELD OF THE INVENTION

The present invention relates to hard alloys based on refructory compounds and processes for making same. Hard alloys based on refractory compounds such as carbides, borides, nitrides, carbonitrides of transition metals can be used in the metallurgy, tool manufacture, electroengineering for the production of cutting tools, hard-alloy attachments, dies and the like.

The wide and effective use of hard alloys in numerous industries is due to a whole number of their valuable properties. The main of these properties is a high hardness (86–92 HRA units) in combination with a high wear-resistance, i.e. high resistance against wear during friction both against metals and non-metallic materials. Hard alloys are capable of retaining these properties at high temperatures as well. Especially efficient is the use of hard alloys in the machine-tool manufacture—for metal machining or cutting.

BACKGROUND OF THE INVENTION

Known in the art are, apart from initially known hard alloys of tungsten monocarbide with cobalt (binder), hard alloys, wherein a portion of tungsten carbide is replaced with titanium, tantalum, niobium carbides. The content of tungsten carbide in these alloys is usually of from 60 to 97% by mass. Hardness of these hard alloys ranges from 86 to 92 HRA units, while their ultimate bending strength is within the range of from 20 to 90 kgf/cm$^2$.

The most high-strength are tungsten-cobalt alloys employed for cutting iron and steel. Titanium-tungsten alloys including those containing tantalum or niobium carbide are less durable but ensure a higher resistance of a cutter and are employed mainly for cutting steel under high-speed conditions.

Recently a great attention has been paid to the use of tungsten-free hard alloys due to rather scarce sources of tungsten. As a rule, the hard base of such alloys is represented by titanium carbide, while nickel doped with molybdenum serves as a binder. These alloys have a high wear-resistance in cutting steel, but due to a high brittleness they are used mainly for semi-finish and finish operations of steel machining.

However, the machine-tool manufacture persistently demands the development of new, more wear-resistant hard alloys capable of being used for machining of hardened steel at high cutting speeds.

At the present time in the industry it is necessary to machine steels of a high hardness range of from 15 to 65 HRC units. The machining of hardened steels having hardness of from 35 to 65 HRC units is accompanied by considerable difficulties. Thus, titanium-tungsten alloys are used mainly for machining of steel having hardness not over 35 HRC units. For machining of steels with a hardness above 35 HRC units these alloys are unsuitable due to an insufficient hardness thereof.

From this standpoint the most promising are mineral-ceramic materials based on alumina $Al_2O_3$ doped with high-melting carbides possessing a high hardness—up to 94 HRA units ("Cermets", ed. by J. R. Tincklepaud and W. B. Crandall, 1962, "Inostrannaja Literatura" (Foreign Literature) Publishing House, Moscow, p. 236–279). These materials, in fact, make it possible to carry out machining of hardened steel with a hardness of up to 65 HRC units. However, these mineral-ceramic materials have a low strength (ultimate bending strength is 70 kgf/mm$^2$) and a low thermal conductivity, wherefore these are employed in cutting tools with a sophisticated cutter shape hindering its breaking. Despite the high hardness of mineral-ceramic materials, they cannot fully replace hard alloys in machining of steels, but only complement them in certain cutting operations.

To increase hardness of hard alloys, borides of transition metals, mainly titanium diboride, have been suggested to be added.

Thus, known is a hard alloy based on titanium diboride which consists of the following components, percent by mass:

tungsten carbide—23 to 25
cobalt—13 to 13.5
titanium diboride—the balance.

(cf. USSR Inventor's Certificate No. 514031, Bulletin "Discoveries, Inventions, Industrial Designs and Trademarks", No. 18, published May 15, 1976, Class C 22 c 29/00).

The hard alloy having the above-specified composition is used only as an abrasive material, since it possesses no necessary mechanical strength enabling manufacture of cutters therefrom.

Known in the art is a tungsten-free hard alloy based on titanium diboride consisting of the following components, percent by mass:

titanium diboride—52 to 68
titanium carbide—13 to 17
cobalt—5 to 18
carbon—1 to 2
molybdenum and/or molybdenum boride and/or molybdenum carbide—9 to 15

(cf. USSR Inventor's Certificate No. 523954, Bulletin "Discoveries, Inventions, Industrial Designs and Trademarks" No. 29, published Aug. 5, 1976, Cl. C 22 c 29/00).

The hard alloy of the above-specified composition has a high hardness, but is unsuitable for the manufacture of cutting tools due to insufficient mechanical strength thereof and can be used only as an abrasion material.

Also known is a tungsten-free hard alloy consisting of titanium diboride, titanium carbide and a binder based on a metal of the group of iron; the components of the binder are present in the following mass proportions: B-2–3.5, Si-3.5–4.8, Ni-1, C-2, Li-0.01, Co-20 (cf. Japanese Application No. 50-20947, Tok-yo-Koho, published July 19, 1975, Cl. B 22 F 3/28).

This alloy can neither be used for machining of steel due to an insufficient mechanical strength.

Therefore, the attempts of incorporation of borides of transition metals and traditional binding metals from the group of iron in the composition of hard alloys have not resulted in the provision of durable alloys due to the formation, in these systems, of low-melting brittle eutectics of boron with metals of the group of iron or brittle borides of these metals (cf. H. J. Goldsmith, "Alloys of Implantation" part I, 1971, MIR Publishing House, Moscow, pp. 364–413).

Lack of hard alloys possessing a high wear-resistance and hardness at a sufficiently high operation durability suitable for machining of steel with a hardness of from 35 to 65 HRC units has brought about a problem of an urgent importance.

The process for the manufacture of the above-mentioned hard alloys involves the production of high-melting compounds with subsequent use of techniques of the powder metallurgy comprising preparation of a charge by intermixing of powders of the resulting high-melting compounds with a binding metal, compression of blanks and sintering at a temperature of from 1,350° to 1,550° C. for several hours in vacuum or hydrogen electric furnaces (cf. V. I. Tretiakov "Foundations of Physical Metallurgy and Technology of Production of Hard Alloys", 1976, Metallurgy Publishing House, Moscow, p. 7).

One of the most commonly used way of the manufacture of high-melting compounds for hard alloys (carbides, borides, nitrides of transition metals) resides in the synthesis thereof from corresponding metals (or their oxides) and non-metal (carbon, boron, nitrogen) in electric furnaces at a temperature of from 1,600° to 2,200° C. for a period of several hours (see the book op. cit., pp. 265–293).

Another, economically and technologically pure efficient way for the production of high-melting compounds resides in that at least one metal selected out of V–VI Groups of the periodic system is mixed with at least one of non-metal selected from the group of carbon, nitrogen, boron, silicon, oxygen, phosphorus, fluorine, chlorine and the resulting charge is locally ignited by any conventional method, e.g. by means of a tungsten coil. This creates a temperature necessary for initiation of an exothermal reaction of metals with non-metals in a small volume of the charge. Further the process of interaction of the charge components necessitates no use of external heating sources and proceeds at the account of the heat of the exothermal reaction per se. The reaction spontaneously propagates within the charge under burning conditions due to the heat transfer from the heated layer of the charge to the cold one at the burning speed of 4 to 16 m/sec (cf. U.S. Pat. No. 3,726,643 Cl. C01 B, published 1973).

This prior art process for the production of hard alloy involves several stages: the stage of a preliminary preparation of high-melting compounds and the subsequent treatment thereof by techniques known in powder metallurgy. Furthermore, this process is characterized by high rates of consumption of electric power.

DISCLOSURE OF THE INVENTION

The present invention is directed to the provision, in a tungsten-free hard alloy consisting of titanium diboride, titanium carbide and a binder, of such a binder and such proportions of the components which would ensure a high hardness and wear-resistance of the hard alloy at a sufficiently high mechanical strength thereof, as well as to the provision of a process for the production of the hard alloy which would be technologically simple and economically efficient.

This object is accomplished by a tungsten-free hard alloy consisting of titanium diboride, titanium carbide and a binder, wherein, according to the present invention, as the binder use is made of at least one metal of subgroup IB of the periodic system inactive relative to boron or an alloy based on one of these metals, the components are present in the tungsten-free hard alloy in the following proportions, percent by mass:

titanium diboride—40 to 60 binder—3 to 30 titanium carbide—the balance;

the tungsten-free hard alloy of this composition has a porosity of below 1%.

It is advisable to use copper and its alloys as a binder according to the present invention.

The use, as a binder, of metals of subgroup IB of the periodic system with the fully occupied d-sublevel and inactive relative to boron, as well as alloys based thereon makes it possible to obtain a hard alloy with a high hardness (up to 94 HRA units), a high wear-resistance (higher than in known titanium-tungsten alloys), a high thermal conductivity at a sufficiently high mechanical strength (ultimate bending strength is 60 to 115 kgf/mm$^2$).

The hard alloy according to the present invention does no incorporate expensive and hardly-available tungsten, though its operating performance is very close to that of tungsten-based hard alloys.

The tungsten-free hard alloy of the above-specified composition according to the present invention can be used for machining of steels both unhardened and hardened having hardness within the range of from 15 to 55 HRC units.

The above-specified proportions of the components in the tungsten-free hard alloy according to the present invention ensure a high wear-resistance and a high hardness of the alloy at a sufficiently high mechanical strength thereof.

Decreasing the content of titanium diboride in the alloy below 40% by mass results in a lowered wear-resistance and hardness of the alloy, whereas increasing the content of titanium diboride above 60% by mass—in a lowered mechanical strength of the alloy.

Decreasing the amount of the binder in the alloy below 3% by mass results in increased brittleness, i.e. reduction of its mechanical strength, while increasing the content of the binder above 30% by mass results in a lowered wear-resistance and hardness of the alloy.

Increasing porosity of the tungsten-free hard alloy according to the present invention above 1% results in impaired operating performance thereof. It is advisable to produce the hard alloy with the minimum possible percentage of porosity.

The present invention also relates to the process for producing a tungsten-free hard alloy which comprises preparation of the starting charge by mixing powders of titanium, boron and carbon, compression of the charge, its local ignition for initiation of an exothermal reaction which further proceeds spontaneously under burning conditions while being propagated within the charge due to the heat transfer from a heated layer of the charge towards a cold one; in accordance with the present invention, in the stage of preparation of the charge the latter is incorporated with a powder of at least one metal of subgroup IB of the periodical system inactive relative to boron, or a powder of an alloy based on one of such metals, or powders of metals forming such alloy under the conditions of the above-mentioned exothermal reaction, while on completion of the exothermal reaction the resulting solid-liquid reaction mass is compressed to a porosity of below 1%.

During the combustion there occurs the formation of titanium diboride and carbide, melting and spreading of the low-melting binder. As the reaction zone propagates (the burning zone) within the charge, a solid-liquid mass is formed which consists of solid micrograins of titanium carbide and diboride and microdrops of the molten binder. The subsequent compression of the hot reaction mass on completion of the combustion process makes it possible to obtain a compact material with a porosity of below 1%. High burning rates (up to 4 cm/sec) make it possible to perform the entire procedure of the production of a tungsten-free hard alloy within several seconds.

The process according to the present invention is simple and can be performed using conventional equipment. It enables combination, in the same process, preparation of high-melting compounds and sintering thereof with the binder. Furthermore, the process according to the present invention makes it possible to substantially reduce the electric power consumption.

BEST MODE FOR CARRYING-OUT THE INVENTION

The process for producing the tungsten-free hard alloy according to the present invention is carried out in the following preferred manner.

The starting charge is prepared by mixing a powder of the binder with powders of titanium, boron and carbon. The binder content in the starting charge corresponds to its content in the final alloy of the predetermined composition. Titanium, boron and carbon are employed in such a ratio that their further interaction with the formation of titanium carbide and diboride would result in a hard alloy of the predetermined composition.

As the binder use is made of at least one of metals of subgroup I B of the periodic system inactive to boron (copper, silver, gold) or an alloy based on one of the above-mentioned metals such as an alloy of copper with 3–13% of nickel and 1.5–6% of aluminium, an alloy of copper with 30% of nickel and 3% of chromium or molybdenum, an alloy of copper with 1% of zinc, an alloy of copper with 2% of scandium or yttrium, an alloy of silver with 3–10% of nickel, an alloy of silver with 3% of yttrium or scandium, an alloy of gold with 3 to 10% of chromium, as alloy of gold with 10% of scandium or yttrium.

If the tungsten-free hard alloy incorporates, as the binder, an alloy based on a metal of subgroup IB of the periodic system, e.g. an alloy of copper with nickel and aluminium (nickel-aluminium bronze), into the composition of the starting charge there may be incorporated either a powder of the final alloy, for example bronze powder, or powders of metals incorporated in the composition of this alloy, e.g. powders of copper, nickel and aluminium.

The obtained starting charge is compressed, e.g. to a relative density of 0.6 and charged, e.g. into a mould, gasostat or hydrostat provided with an ignition means embodied as, for example, a tungsten coil.

The charge is locally ignited, wherefore through, e.g. the tungsten coil touching the surface of the charge, electric current is passed for about 0.5 second. As a result, in this particular area of the charge a temperature is developed which is necessary for initiation of a high-temperature exothermal reaction of titanium with boron and carbon. Further the process of interaction between the above-mentioned charge components requires no use of external heating sources and proceeds at the account of the heat of the proper exothermal reaction.

Owing to the heat transfer from heated layers of the charge to cold ones there occurs a spontaneous propagation of the reaction zone (burning zone) within the charge at a speed of up to 4 cm/sec and the temperature in the burning zone becomes as high as 2,550° C.

In the burning zone there takes place the formation of titanium diboride and carbide, melting and spreading of the binder, wherefore, a solid-liquid mass is formed which consists of micrograins of titanium diboride and carbide and microdrops of the molten binder.

On completion of the exothermal reaction (burning process) the resulting solid-liquid reaction mass is compressed, e.g. in a mould, gasostat or hydrostat under a pressure of from 0.5 to 2 t/cm$^2$ to achieve porosity of the final hard alloy of below 1%.

According to the data of X-ray phase analysis, the resulting tungsten-free hard alloy consists of titanium carbide and diboride and a binder; the crystal lattice parameters of titanium carbide and diboride correspond to the data known from the literature.

According to the data of metallographic analysis, the tunsten-free hard alloy according to the present invention consists of a mixture of grains of titanium carbide of an irregular shape and needle-like grains of titanium diboride with the binder being uniformly distributed therebetween. The grain size of titanium diboride and titanium carbide is not more than 5$\mu$.

The following characteristics of the tungsten-free hard alloy produced by the above-described process have been determined: density, porosity, hardness, durability and wear-resistance.

Density ($\rho$, g/cm$^3$) of the tungsten-free hard alloy is determined by means of picnometer. Porosity ($\alpha$, %) of the hard alloy is determined theoretically using the picnometric density data. The alloy hardness is determined by the generally accepted procedure (against the HRA scale) and its mechanical strength represented by ultimate bending strength ($\sigma_{bend.}$, kgf/mm$^2$).

The data on wear-resistance of the hard alloy according to the present invention have been obtained during tests of cutters manufactured from this hard alloy upon cutting of steel by means of these cutter in a lathe.

The wear-resistance tests have been performed using two procedures.

According to the first procedure, the criterion of wear-resistance of the cutter is wear thereof (h, mm) upon cutting of a sample of a non-hardned steel with the hardness of 15 HRC units for 20 min at the cutting speed (v) 200 m/min feed (s) 0.17 mm/rev. and cutting depth (t) of 1.5 mm.

According to the second procedure, the criterion of wear-resistance is the critical speed ($v_{cr}$, m/min) at which the main cutting tip of the cutter is fully broken during end face turning of a non-hardened steel with the hardness of 15 HRC units and hardened steel with the hardness of 55 HRC units performed continuously with an increasing rate of penetration of the cutter into the steel sample. The cutting conditions are as follows:

| | Non-hardened steel | Hardened steel |
|---|---|---|
| Spindle rotation speed (n), r.p.m. | 1,000 | 500 |
| Feed (s), mm/rev. | 0.26 | 0.195 |
| Cutting depth (t), mm | 1.5 | 0.7. |

For the purpose of comparison under similar conditions there have been tested cutters from two known commercial titanium-tungsten alloys; one comprises 15% by mass of titanium carbide and 6% by mass of cobalt, the balance being tungsten carbide (composition 1); the second alloy comprises: 30% by mass of titanium carbide, 4% by mass of cobalt, the balance being tungsten carbide (composition II), as well as cutters of a known commercial tungsten-free alloy comprising 80% by mass of titanium carbide, 15% by mass of nickel and 5% by mass of molybdenum.

For a better understanding of the present invention some specific examples illustrating its embodiments are given hereinbelow.

The properties of the tungsten-free hard alloys obtained in these Examples and those of known commercial titanium-tungsten and tungsten-free alloys determined by the above-described procedures are given in the Table after the examples.

EXAMPLE 1

A tungsten-free hard alloy is produced having the following composition, percent by mass:

titanium diboride—60
binder-silver—3
titanium carbide—37

To this end, the starting powder-like charge is prepared consisting of the following components, percent by mass: titanium-70.9, boron-18.7, carbon-7.4, silver-3. The starting charge is prepared by mixing powders of the above-mentiond components. The resulting charge is compressed to a relative density of 0.6 and placed into a mould provided with a tungsten coil. Electric current is passed though the tungsten coil for 0.5 second, the charge is locally ignited thus initiating the exothermal reaction of titanium with boron and carbon which then proceeds spontaneously under burning conditions. Owing to the heat transfer from the heated charge layers to the cold ones the reaction zone (or burning zone) is propagated within the charge at the speed of 4 cm/sec and the temperature in the burning zone becomes as high as 2,550° C.

In the burning zone there takes place the formation of titanium diboride and carbide, melting and spreading of the binder-silver.

On completion of the exothermal reaction the resulting solid-liquid reaction mass is subjected to compression in a mould under the pressure of 0.5 t/cm$^2$.

EXAMPLE 2

A tungsten-free hard alloy is produced with the following composition, percent by mass:

titanium diboride—50
binder-copper—10
titanium carbide—40.

To this end, the starting charge is used which has the following composition, percent by mass: titanium-66.5, boron-15.5, carbon-8, copper-10.

The charge preparation and production of the tungsten-free hard alloy therefrom are effected as described in Example 1, except that the solid-liquid reaction mass is compressed in a mould under the pressure of 2 t/cm$^2$.

EXAMPLE 3

A tungsten-free hard alloy is produced which has the following composition, percent by mass:

titanium diboride—40
binder-alloy comprising 82% by mass of copper, 12% by mass of nickel and 6% by mass of aluminium (nickel-aluminium bronze)—30
titanium carbide—30.

The preparation of the starting charge is effected by intermixing of powders of titanium, boron, carbon with a powder of nickel-aluminium bronze. The charge has the following composition, % by mass: titanium-51.6, boron-12.4, carbon-6, nickel-aluminium bronze-30.

Preparation of the tungsten-free hard alloy from the resulting charge is effected in a manner similar to that described in the foregoing Example 1.

EXAMPLE 4

A tungsten-free hard alloy is produced which has the following composition, percent by mass:

titanium diboride—50
binder-copper and silver (mass ratio of the metals is 4:1 respectively)—5
titanium carbide—45.

The starting charge having the following composition, percent by mass: titanium-70.5, boron-15,5, carbon-9, copper-4, silver-1, is prepared by intermixing powders of titanium, boron, carbon, copper and silver.

The production of the tungsten-free hard alloy from the thus-prepared starting charge is effected in a manner similar to that described in Example 1 hereinbefore.

EXAMPLE 5

A tungsten-free hard alloy is produced which has the following composition, percent by mass:

titanium diboride—60
binder-copper and gold (mass ratio between the metals is 5:1 respectively)—3
titanium carbide—37.

The starting charge having the following composition, percent by mass: titanium-70.9, boron-18.7, carbon-7.4, copper-2.5, gold-0.5 is prepared by intermixing powders of titanium, boron, carbon, copper and gold.

The tungsten-free hard alloy is produced from the thus-prepared charge in a manner similar to that described in Example 1 hereinbefore.

EXAMPLE 6

A tungsten-free hard alloy is prepared which has the following composition, percent by mass:

titanium diboride—54
binder-alloy consisting of 91% by mass of copper, 6% by mass of nickel and 3% by mass of aluminium—10
titanium carbide—36.

The starting charge is prepared by intermixing powders of titanium, boron, carbon with powders of the metals forming the alloy of copper under the conditions of the exothermal reaction, namely with powders of copper, nickel and aluminium. The charge has the following composition, percent by mass: titanium-66, boron-16.8, carbon-7.2, copper-9.1, nickel-0.6, aluminium-0.3.

The tungsten-free hard alloy is produced from the resulting charge in a manner similar to that described in Example 1.

EXAMPLE 7

A tungsten-free hard alloy is produced which has the following composition, percent by mass:

titanium diboride—54,
binder-alloy consisting of 67.2% by mass of copper, 30% by mass of nickel and 2.8% by mass of chromium (chrome-nickel bronze)—10
titanium carbide—36.

The starting charge is prepared by intermixing powders of titanium, boron, carbon and chrome-nickel bronze. The charge has the following composition, percent by mass: titanium-66, boron-16.8, carbon-7.2, chrome-nickel bronze-10.

The tungsten-free hard alloy is produced from the resulting charge as described in Example 1, except that the solid-liquid reaction mass is compressed in a mould under the pressure of 2 t/cm$^2$.

EXAMPLE 8

A tungsten-free hard alloy is prepared which has the same composition as specified in the foregoing Example 7.

The starting charge is prepared by intermixing powders of titanium, boron and carbon with powders of the metals forming a copper-based alloy under the conditions of the exothermal reaction, namely with powders of copper, nickel and chromium. The charge has the following composition, percent by mass: titanium-66, boron-16.8, carbon-7.2, copper-6.7, nickel-3, chromium-0.3.

The tungsten-free hard alloy is produced from the resulting charge in a manner similar to that described in Example 1.

EXAMPLE 9

A tungsten-free hard alloy is produced which has the following composition, percent by mass:

titanium diboride—58 binder-alloy comprising 96.7% by mass of silver and 3.3% by mass of scandium—3 titanium carbide—39.

The starting charge is produced by intermixing powders of titanium, boron, carbon, silver and scandium. The charge has the following composition, percent by mass: titanium-71.2, boron-18, carbon-7.8, silver-2.9, scandium-0.1.

The tungsten-free hard alloy is produced from the resulting charge in a manner similar to that described in Example 1 hereinbefore.

EXAMPLE 10

A tungsten-free hard alloy is produced which has the following composition, % by mass:

titanium diboride—58 binder-an alloy comprising 90% by mass of gold and 10% by mass of yttrium—3 titanium carbide—39.

The starting charge is prepared by intermixing powders of titanium, boron, carbon, gold and yttrium. The charge has the following composition, percent by mass: titanium-71.2, boron-18, carbon-7.8, gold-2.7, yttrium-0.3.

The tungsten-free hard alloy is produced from the resulting charge by a procedure similar to that described in Example 1.

EXAMPLE 11

A tungsten-free hard alloy is produced which has the following composition, percent by mass:

titanium diboride—54 binder-an alloy comprising 90% by mass of copper and 10% by mass of zinc—10 titanium carbide—36.

The starting charge is prepared by mixing powders of titanium, boron, carbon, copper and zinc. The charge has the following composition, percent by mass: titanium-67, boron-15.8, carbon-7.2, copper-9, zinc-1.

The tungsten-free hard alloy is produced from the resulting charge by the procedure which is similar to that described in Example 1.

EXAMPLE 12

A tungsten-free hard alloy is produced which has the following composition, percent by mass:

titanium diboride—50 binder-an alloy consisting of 80% by mass of copper 15% by mass of nickel and 5% by mass of molybdenum—20 titanium carbide—30.

The starting charge is prepared by intermixing powders of titanium, boron, carbon, copper, nickel and molybdenum. The charge has the following composition, percent by mass: titanium 58.4, boron-15.6, carbon-6, copper-16, nickel-3, molybdenum-1.

The tungsten-free hard alloy is produced from the resulting charge in a manner similar to that described in Example 1.

EXAMPLE 13

A tungsten-free hard alloy is produced which has the following composition, percent by mass:

titanium diboride—57 binder-an alloy consisting of 96% by mass of copper and 4% by mass of molybdenum—5 titanium carbide—38.

The starting charge is produced by intermixing powders of titanium, boron, carbon, copper and molybdenum. The charge has the following composition, percent by mass: titanium-69.7, boron-17.7, carbon-7.6 copper-4.8, molybdenum-0.2.

The tungsten-free hard alloy is produced from the resulting charge in a manner similar to that described in Example 1 hereinbefore.

EXAMPLE 14

A tungsten-free hard alloy is produced which has the following composition, percent by mass:

titanium diboride—57 binder-an alloy comprising 96% by mass of copper and 4% by mass of aluminium—5 titanium carbide—38.

The starting charge is prepared by intermixing powders of titanium, boron, carbon, copper and aluminium. The charge composition is as follows, percent by mass titanium-69.7, boron-17.7, carbon-7.6, copper-4.8, aluminium-0.2.

The tungsten-free hard alloy is produced from the resulting charge in a manner similar to that described in Example 1.

EXAMPLE 15

A tungsten-free hard alloy is produced which has the following composition, percent by mass:

titanium diboride—57 binder-an alloy consisting of 96% by mass of copper and 4% by mass of chromium—5 titanium carbide—38.

The starting charge is produced by intermixing powders of titanium, boron, carbon, copper and chromium. The charge has the following composition, percent by mass: titanium-69.7, boron-17.7, carbon-7.6, copper-4.8, chromium-0.2.

The tungsten-free hard alloy is produced from the resulting charge in a manner similar to that described in Example 1

EXAMPLE 16

A tungsten-free hard alloy is produced which has the ollowing composition, percent by mass:

titanium diboride—57 binder-an alloy comprising 98% by mass of copper and 2% by mass of scandium—5 titanium carbide—38.

The starting charge is prepared by intermixing pow-ers of titanium, boron, carbon, copper and scandium. The charge has the following composition, percent by nass: titanium-69.7, boron-17.7, carbon-7.6, copper-4.9, candium-0.1.

The tungsten-free hard alloy is produced from the esulting charge in a manner similar to that described in Example 1, except that the solid-liquid reaction mass is ompressed in a mould under the pressure of 1 t/cm$^2$.

EXAMPLE 17

A tungsten-free hard alloy is produced which has the ollowing composition, percent by mass:

titanium diboride—57 binder-an alloy consisting of 98% by mass of copper and 2% by mass of yttrium—5 titanium carbide—38.

The starting charge is produced by mixing powders of titanium, boron, carbon, copper and yttrium. The charge has the following composition, percent by mass: itanium-69.7, boron-17.7, carbon-7.6, copper-4.9, yttri-um-0.1.

The tungsten-free hard alloy is produced from the esulting charge in a manner similar to that described in Example 1, except that the solid-liquid reaction mass is compressed in a mould under the pressure of 1 t/cm$^2$.

In the following Table there are shown the properties of the tungsten-free hard alloy produced in the above-given Examples and those of known commercial tungsten-free and titanium-tungsten hard alloys.

As it is seen from the Table, the tungsten-free hard alloy according to the present invention can be used for machining of both non-hardened steels with the hardness of 15 HRC units and hardened steels with the hardness of up to 55 HRC units. As regards its hardness and wear-resistance, the tungsten-free hard alloy according to the present invention is not inferior to, and in some cases is even superior over the prior art commercial tungsten-titanium alloys (see Examples 15, 16, 17).

INDUSTRIAL APPLICABILITY

The tungsten-free hard alloy according to the present invention can be used in metallurgy, machine-tool manufacture, electroengineering for the manufacture of cutting tools, hard-alloy attachments, dies and the like.

TABLE

| Hard alloy 1 | Density, ρ, g/cm$^3$ 2 | Porosity, α, % 3 | Hardness, HRA units 4 | Ultimate bending strength, σ bend, kgf/mm$^2$ 5 | Wear resistance: Cutter wear, h,mm 6 | Critical speed, $V_{cr}$, m/min: un-hardened steel (15 HRC) 7 | hardened steel (55 HRC) 8 |
|---|---|---|---|---|---|---|---|
| Tungsten-free hard alloy of: | | | | | | | |
| Example 1 | 4.72 | 0.6 | 93.5 | — | — | — | — |
| Example 2 | 4.91 | 0.4 | 91.5 | 90 | 0.15 | 600–630 | 150 |
| Example 3 | 5.29 | 0.7 | 88 | 115 | — | — | — |
| Example 4 | 4.80 | 0.8 | 93 | 70 | 0.1 | 650–700 | 130 |
| Example 5 | 4.66 | 0.7 | 93 | 60 | — | — | — |
| Example 6 | 4.87 | 0.6 | 91.5 | 85 | 0.1 | 600–630 | 140 |
| Example 7 | 4.90 | 0.4 | 92 | 85 | 0.1 | 630–650 | 150 |
| Example 8 | 4.89 | 0.6 | 91.5 | 85 | 0.1 | 630–650 | 140 |
| Example 9 | 4.73 | 0.6 | 92 | 60 | — | — | — |
| Example 10 | 4.75 | 0.6 | 93 | — | — | — | — |
| Example 11 | 4.88 | 0.8 | 93 | — | — | — | — |
| Example 12 | 5.13 | 0.7 | 90 | 110 | 0.2 | 540–570 | — |
| Example 13 | 4.75 | 0.7 | 92.5 | 75 | 0.1 | 630–650 | 140 |
| Example 14 | 4.74 | 0.7 | 93 | — | — | — | — |
| Example 15 | 4.74 | 0.7 | 93 | 75 | 0.1 | 700–750 | 280 |
| Example 16 | 4.75 | 0.6 | 94 | 80 | 0.1 | 700–750 | 300 |
| Example 17 | 4.75 | 0.6 | 94 | 80 | 0.1 | 700–750 | 300 |
| Commercial tungsten-free hard alloy, % by mass: 80 TiC, 15 Ni, 5 Mo | — | — | 90 | 120 | 0.35 | 400–580 | The alloy is unsuitable for machining hardened steel of the above hardness |
| Commercial titanium-tungsten hard alloy (composition I) | | — | 90–90.5 | 110 | 0.3 | 400–580 | The alloy is unsuitable for machining steel with the above-mentioned hardness |
| Commercial titanium-tungsten hard alloy (composition II) | — | — | 91–91.5 | 90 | — | 650–700 | 80–100 |

We claim:

1. A process for producing a tungsten-free hard alloy having porosity below 1% and containing the following components, percent by mass:

(a) titanium diboride—40 to 60, (b) a binder which contains an alloy of copper, nickel and aluminum based on at least one metal of subgroup IB of the periodic system inactive relative to boron and a powder of the final alloy such as bronze powder or powders of copper, nickel and aluminum—3 to 30, and (c) titanium carbide—the balance; and comprising preparation of a starting charge by intermixing powders of titanium, boron and carbon, compression of the charge, local ignition thereof for initiation of the exothermal reaction of titanium with boron and carbon which further proceeds spontaneously under burning conditions while propagating within the charge due to the heat transfer from a heated layer of the charge to a cold one, and at the stage of the charge preparation a powder of at least one metal of subgroup 1B of the periodic system is incorporated into the charge and a powder of an alloy based on one of said metals of subgroup 1B, or powders of metals forming such alloy under the conditions of said exothermal reaction are incorporated into the charge and on completion of the exothermal reaction the resulting solid-liquid reaction mass is subjected to compression until a porosity of below 1% is obtained.

2. The process according to claim 1 wherein the starting charge is compressed to a relative density of 0.6 and then charged into a mould, gasostat and hydrostat having an ignition means.

3. The process according to claim 2 including the steps of touching the surface of the charge and passing electric current for about 0.5 seconds to initiate the high temperature exothermal reaction, free of any external heating sources, of the titanium with the boron and carbon.

4. The process according to claim 1 wherein compression takes place in a mould, gasostat or hydrostat under a pressure of 0.5 to 2 t/cm$^2$.

5. The process according to claim 1 wherein a burning rate up to 4 cm/sec is obtained to provide for the completion of the procedure within several seconds.

6. The process according to claim 1 wherein the starting charge corresponds to its content in the final alloy.

7. The process according to claim 1 wherein the starting charge is in mass percent:

titanium—70.9
carbon—7.4
boron—18.7
silver—3.0 and the tungsten free alloy produced has the following compositions in percent by mass:

titanium diboride—60
binder-silver—3
titanium carbide—37.

8. The process according to claim 1 wherein the alloy produced is composed of 50% titanium diboride, copper binder 10% and titanium 40%, in mass percent from a starting charge consisting of in percent by mass of titanium 66.5, boron 15.5, carbon 8 and copper 10.

9. The process according to claim 1 comprising compressing the starting charge to a relative density of 0.6, touching the surface of the charge for igniting thereof with an electric current for 0.5 seconds to provide a spontaneous propogation of the reaction zone within the charge at a speed up to 4 cm/sec to produce a temperature therein up to 2,550° C. to form titanium diboride and carbide, melting and spreading of the binder to produce the solid-liquid mass which consists of micrograins of titanium diboride and carbide and microdrops of the molten binder.

10. The process of claim 9 wherein the resulting solid-liquid reaction mass is compressed under a pressure between 0.5 to 2 t/cm$^2$ to achieve the porosity of the final hard alloy below 1%.

11. A tungsten-free hard alloy comprising titanium diboride, titanium carbide and a binder; wherein the binder contains:

at least one of metal of subgroup IB of the periodic system inactive relative to boron and an alloy based on one of said metals, the proportions of the components of the tungsten-free hard alloy are as follows, percent by mass:

titanium diboride—40 to 60
binder—3 to 30
titanium carbide—the balance, the tungsten-free hard alloy has a porosity below 1%; and the binder is an alloy of copper, nickel and aluminum, and a powder of the final alloy such as bronze powder or powders of copper, nickel and aluminum are incorporated.

12. The alloy according to claim 11 wherein the alloy consists of a mixture of grains of titanium carbide of an irregular shape and needle-like grains of titanium diboride with the binder uniformly distributed therebetween, and the grain size of the titanium diboride and titanium carbide is not more than 5$\mu$.

13. The alloy according to claim 11 for use in machining of steel having a hardness within the range of 15 to 55 HRC units.

14. The alloy according to claim 11 for use in machining of steel having a hardness within the range of 15 to 55 HRC units.

15. The alloy according to claim 11 wherein one of the metals of subgroup 1B has a fully occupied d-sublevel.

16. A tungsten-free hard alloy comprising titanium diboride, titanium carbide and a binder, wherein the binder contains at least one metal of subgroup 1B of the periodic system inactive relative to boron or an alloy based on one of said metals, relative to boron or an alloy based on one of said metals, the proportions of the components of the tungsten-free hard alloy are as follows, percent by mass:

titanium diboride—40 to 60
binder—3 to 30
titanium carbide—the balance, the tungsten-free hard alloy has a porosity below 1%, and the binder is an alloy selected from the group consisting of copper with 3–13% nickel and 1.5–6% aluminum, copper with 30% nickel and 3% chromium or molybdenum, copper with 1% zinc, copper with 2% scandium or yttrium, silver with 3% yttrium or scandium, gold with 3 to 10% chromium, and gold with 10% scandium or yttrium.

17. The alloy according to claim 16 wherein one of the metals of subgroup 1B has a fully occupied d-sublevel.

18. The alloy according to claim 16 wherein the alloy consists of a mixture of grains of titanium carbide of an irregular shape and needle-like grains of titanium diboride with the binder uniformly distributed therebetween, and the grain size of the titanium diboride and titanium carbide is not more than 5$\mu$.

* * * * *